US008708251B2

(12) United States Patent
Leer

(10) Patent No.: US 8,708,251 B2
(45) Date of Patent: Apr. 29, 2014

(54) TANK SPRAYER ASSEMBLY INCLUDING TANK COMPONENT AND SPRAYER PACKAGE SUBASSEMBLY

(75) Inventor: Rick L. Leer, Somerset, PA (US)

(73) Assignee: Robert Bosch GmbH, Stuttgart (DE)

( * ) Notice: Subject to any disclaimer, the term of this patent is extended or adjusted under 35 U.S.C. 154(b) by 806 days.

(21) Appl. No.: 12/903,806

(22) Filed: Oct. 13, 2010

(65) Prior Publication Data

US 2012/0091230 A1 Apr. 19, 2012

(51) Int. Cl.

| | |
|---|---|
| ***B05B 7/30*** | (2006.01) |
| ***A62C 11/00*** | (2006.01) |
| ***B05B 11/06*** | (2006.01) |
| ***B65D 83/00*** | (2006.01) |

(52) U.S. Cl.
USPC ..... 239/361; 239/349; 239/355; 239/360; 222/401; 222/402

(58) Field of Classification Search
USPC ..... 239/333, 337, 349, 355, 359, 360, 361, 239/373, 375; 222/401, 402
See application file for complete search history.

(56) References Cited

U.S. PATENT DOCUMENTS

| | | | | |
|---|---|---|---|---|
| 2,091,735 A | | 8/1937 | Jepson | |
| 4,192,464 A | * | 3/1980 | Chow | 239/373 |
| 5,156,304 A | * | 10/1992 | Battegazzore | 222/341 |
| 6,138,875 A | | 10/2000 | Condon et al. | |
| 8,177,101 B1 | * | 5/2012 | Blake | 222/340 |
| 2006/0065762 A1 | | 3/2006 | Leer et al. | |
| 2007/0175928 A1 | * | 8/2007 | Arcuri et al. | 222/401 |

FOREIGN PATENT DOCUMENTS

FR 2850886 A1 8/2004

OTHER PUBLICATIONS

Pdf Document including supplemental photographs of the tank sprayer packaging depicted in the photographs filed with the IDS on Dec. 30, 2010 and known to be in use at least as early as Oct. 12, 2010.
Pdf Document including photographs of tank sprayer packaging known to be in use at least as early as Oct. 12, 2010.
International Search Report and Written Opinion in corresponding PCT application (i.e., PCT/US2011/061922) completed Mar. 23, 2012 (9 pages).

* cited by examiner

*Primary Examiner* — Ryan Reis
(74) *Attorney, Agent, or Firm* — Maginot, Moore & Beck

(57) ABSTRACT

A tank sprayer assembly includes a tank component and a subassembly, the tank component having a neck that defines a first access opening. The subassembly includes a sprayer component and a packaging container, the packaging container defining a cavity and having a lower wall defining a second access opening. The sprayer component includes a cap and a pump attached to the cap, the cap and the neck being configured to threadingly engage each other. The tank sprayer is positionable in an assembled configuration and disassembled configuration. In the assembled configuration, the cap is aligned with the second access opening, the neck is extended through the second access opening into the cavity, and the neck and the cap are threadingly engaged to secure the sprayer component to the tank component. In the disassembled configuration, the cap is aligned with the second access opening and the neck is spaced apart from the cavity.

17 Claims, 7 Drawing Sheets

TANK SPRAYER ASSEMBLY INCLUDING TANK COMPONENT AND SPRAYER PACKAGE SUBASSEMBLY

FIELD

This invention relates to the field of tank sprayers, and more particularly to a tank sprayer assembly including a tank component and a sprayer package subassembly.

BACKGROUND

Tank sprayer assemblies are often utilized to dispense low viscosity fluids. The assemblies typically include a tank component that is configured to hold a quantity of fluid to be sprayed. A hand pump is coupled to the tank component and is configured to introduce air into the tank component so as to pressurize the fluid therein. A hand sprayer is also coupled to the tank component and is utilized to disperse the pressurized fluid from the tank component.

It is common to manufacture and package for sale a tank sprayer at a site in one country, such as China, and then ship the packaged tank sprayer to another site in a remote country, such as the United States, for sale in the remote country. One disadvantage with the above process exists due to the high cost of shipping the packaged tank sprayer from the site of tank sprayer manufacturing and packaging to the site of tank sprayer sales. The high shipping cost is due in large part to the bulky nature of the packaged tank sprayer.

It would be desirable to provide a tank sprayer assembly and associated method that would facilitate manufacturing and packaging of a much smaller tank sprayer subassembly at a first site, which would then be shipped to a remote second site for assembly with a relatively large tank sprayer component at the remote site, the relatively large tank sprayer component being manufactured at or near the remote site. According to this tank sprayer assembly and associated method, the shipping cost would be significantly reduced while still benefiting from the ability to manufacture and package a substantial part of the tank sprayer assembly at the first site.

SUMMARY

In accordance with one embodiment, a tank sprayer assembly comprises a tank component defining a chamber configured to receive fluid. The tank component includes a neck that defines a first access opening configured to allow access to the chamber. The neck has an externally threaded portion. The tank sprayer assembly also includes a subassembly comprising a packaging container and a sprayer component. The packaging container has a plurality of walls that define a cavity. The plurality of walls include a lower wall that defines a second access opening configured to allow access to the cavity. The sprayer component includes (i) a cap that defines a cap space and has a skirt that includes an internally threaded portion facing the cap space, and (ii) a pump attached to the cap that includes a cylinder and a piston movably positioned within the cylinder. The tank sprayer is positionable in an assembled configuration and disassembled configuration. When the tank sprayer is positioned in the assembled configuration, (i) the internally threaded portion of the cap is aligned with the second access opening of the lower wall, (ii) the neck extends through the second access opening of the lower wall so as to be at least partially positioned within the cavity, and (iii) the externally threaded portion of the neck is meshingly engaged with the internally threaded portion of the skirt of the cap so as to secure said sprayer component to the tank component. When the tank sprayer is positioned in the disassembled configuration, the neck is spaced apart from the cavity of the packaging container.

In another embodiment, a method of assembling a tank sprayer assembly comprises locating a sprayer component having a cap within a cavity of a packaging container so that (i) an internally threaded portion of the cap is aligned with a first access opening defined in a lower wall of the packaging component, and (ii) a subassembly is formed with the sprayer component and the packaging container. A neck of a tank component is then advanced through the first access opening and into the cavity of the packaging container. The tank component is then rotated in relation to the subassembly while the neck is located in the cavity so as to meshingly engage an externally threaded portion of the neck with the internally threaded portion of the cap so as to couple the subassembly to the tank component.

In yet another embodiment, a subassembly of a tank sprayer assembly comprises a packaging container having a plurality of walls that define a cavity. The plurality of walls includes a first wall that defines an access opening configured to allow access to the cavity. A sprayer component includes (i) a cap defining a cap space and has a skirt that includes an internally threaded portion facing the cap space, and (ii) a pump attached to the cap that includes a cylinder and a piston movably secured to the cylinder. Both the cylinder and the piston extend through the cap space. The internally threaded portion is aligned with the access opening, and both the cylinder and the piston extend from the cavity of the packaging container through the access opening.

DESCRIPTION

Figure 1:
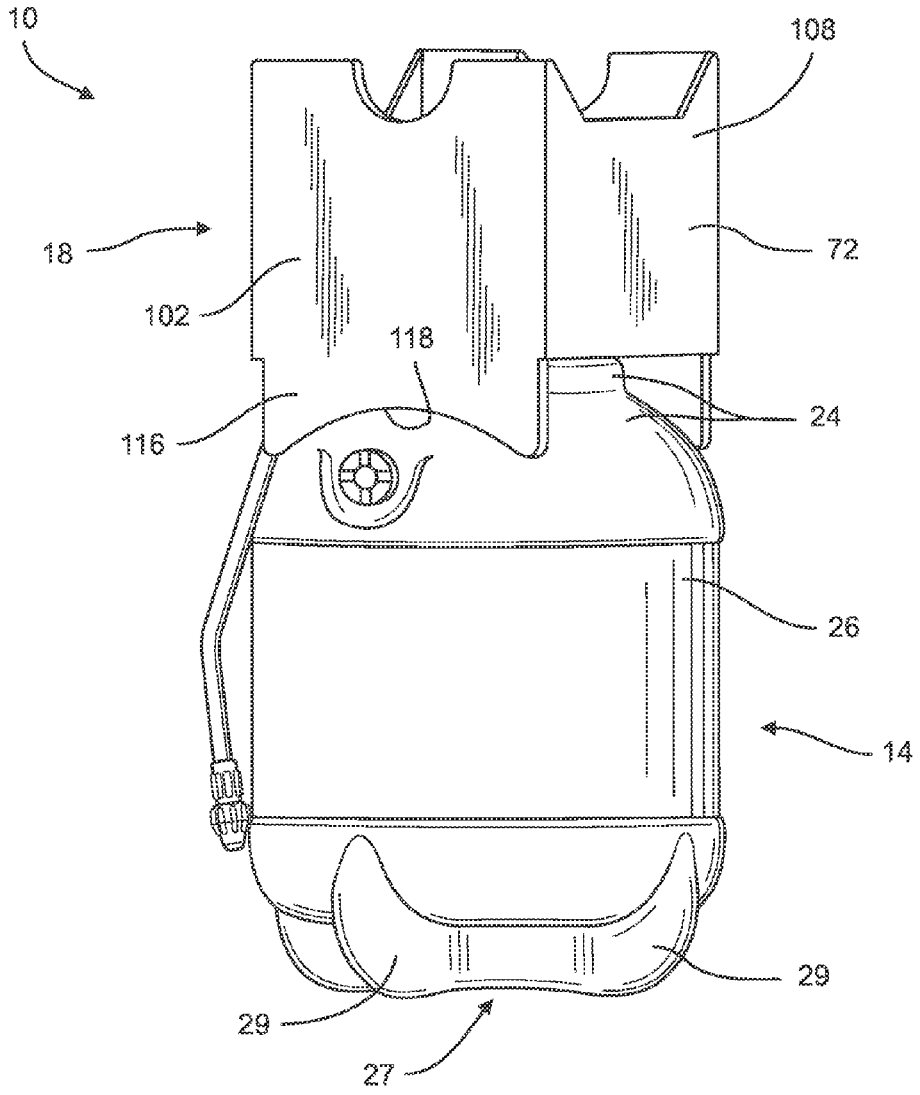
FIG. 1 is a perspective view of a tank sprayer assembly that includes a tank component and a sprayer package subassembly with the sprayer package subassembly assembled to the tank component.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one of ordinary skill in the art to which this invention pertains.

Figure 2:
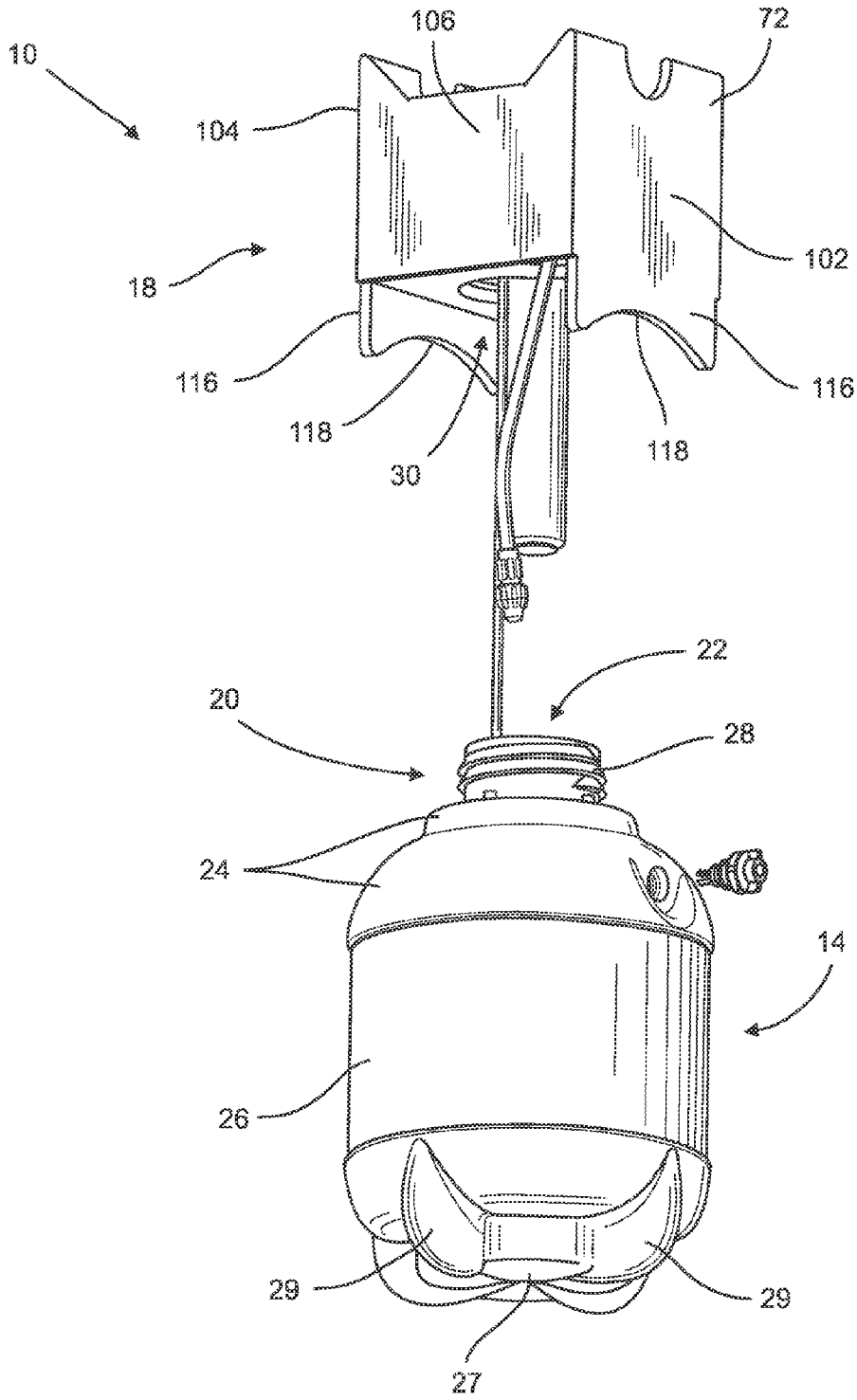
FIG. 2 is a perspective view of the tank sprayer assembly of FIG. 1 in a disassembled configuration showing the sprayer package subassembly spaced apart from the tank component.

With reference to FIG. 1, a tank sprayer assembly 10 in accordance with the present disclosure comprises a tank component 14 and a sprayer package subassembly 18. The sprayer package subassembly includes a package container 72 and sprayer component 30 (see, e.g., FIGS. 2 and 3) for use with the tank component 14. As explained below, the package container 72 of the sprayer package subassembly 18 is configured to retain, support, and protect various parts and mechanisms of the sprayer component 30 in an assembled state to facilitate handling, shipping, and storing of the sprayer package subassembly 18 as a separate unit from the tank component 14. The package container 72 also retains the sprayer package subassembly 18 in a manner that enables the sprayer package subassembly 18 to be readily assembled to the tank component 14. For example, the sprayer package subassembly 18 is configured to be assembled to the tank component 14 without requiring removal of the sprayer component 30 from the package container 72. (see, e.g., FIG. 2).

The tank component 14 of the tank sprayer assembly 10 includes a main body 26 that defines a chamber 16 (see, e.g., FIG. 8) configured to retain a volume of fluid therein. In the exemplary embodiment, the main body 26 is generally cylindrically shaped and is formed of a molded plastic material. The chamber 16 defined by the main body 26 is sized to retain approximately one gallon of fluid within the tank component 14. In other embodiments, the main body 26 and the chamber 16 may be provided in other sizes, shapes, and configurations depending on various factors, such as the intended application, desired level of portability, type of fluid to be retained, and the like. Also, the main body 26 may be made from materials other than a molded plastic, such as a metallic material.

Figure 8:
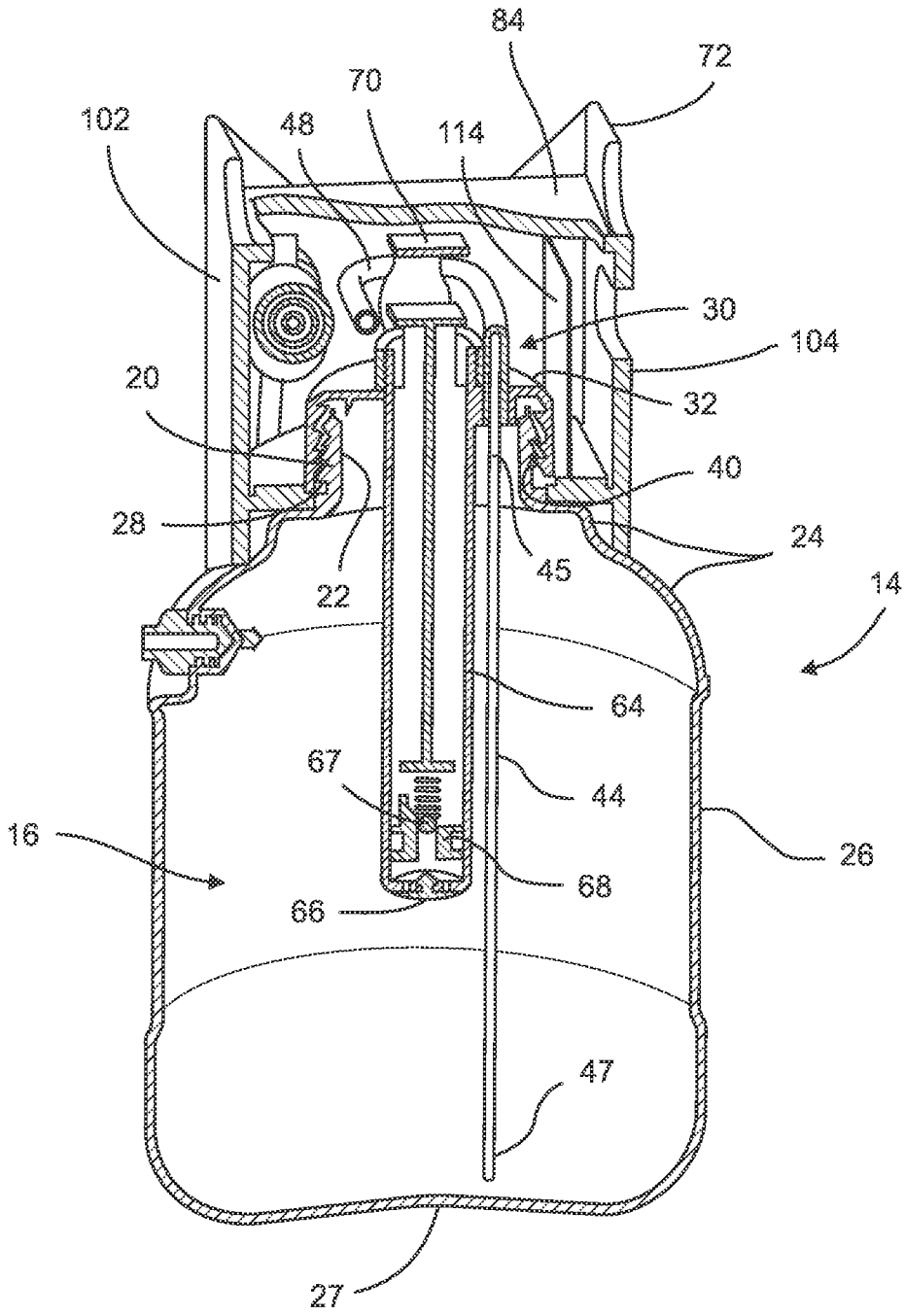
FIG. 8 is a cross-sectional view of the tank sprayer assembly of FIG. 1 showing the sprayer package subassembly assembled to the tank component.

The main body 26 includes a generally flat base 27 with protuberances 29 that extend outwardly from the base 27. This configuration enables the tank component 14 to stand upright on a generally flat surface, such as the ground. A neck 20 extends from a top portion of the main body 26. The neck 20 is generally cylindrical in shape and is narrower than the main body 26 so that the main body defines a shoulder portion 24 that depends from the neck 20. As best seen in FIG. 8, the neck 20 defines an access opening 22 through which fluid enters and leaves the chamber 16. To enable the sprayer component 20 to be secured to the tank component 14, the neck 20 includes an externally threaded surface 28 configured to mesh with an internally threaded surface 40 of a cap 32 of the sprayer component 30.

Referring now to FIGS. 3-7, a sprayer package subassembly 18 includes a cap 32, a hand sprayer 50, and a pump 60. The cap 32 is configured complementary to the neck 20 of the tank component 14 to enable the sprayer component 20 to be releasably attached to the tank component 14. In particular, the cap 32 defines a cap space 34 and includes a skirt portion 38 that defines the internally threaded surface 40 that faces the cap space 34. The threaded surface 40 of the cap is configured to mesh with the threaded surface 28 of the neck 20 of the tank component to secure the sprayer component 30 (as well as the package container 72) to the tank component 14. The cap 32, as well as the other parts and portions of the sprayer component 30 are formed of a sturdy, lightweight material, such as plastic, although any suitable material or combination of materials may be used.

Figure 5:
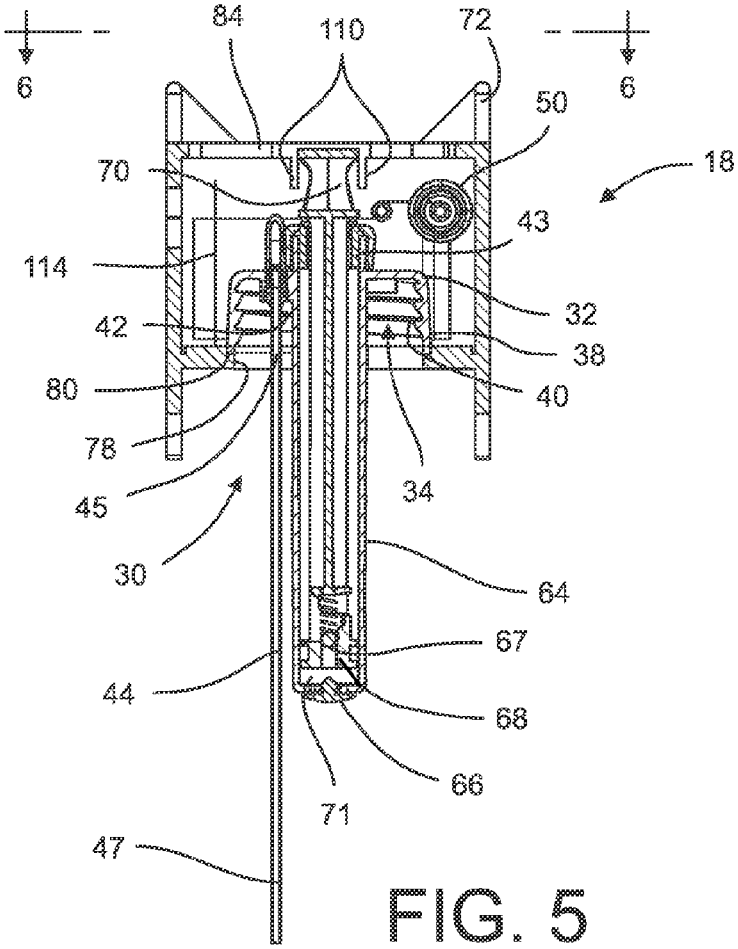
FIG. 5 is a cross-sectional view of the sprayer package subassembly of FIG. 1 taken along lines 5-5 of FIG. 6.

As shown in FIG. 5, the cap 32 defines a fluid passage 42 through which fluid from the chamber 16 is advanced to the hand sprayer 50. An uptake, or siphon, tube 44 is attached to the lower side of the cap 32 with one end portion 45 fluidly coupled to the cap proximate the fluid passage 42. The body of the uptake tube 44 extends from the fluid passage 42 through the cap space 34. So configured, the tube 44 can be inserted into the access opening 22 of the neck 20 and into the chamber 16 of the tank component 14 when the sprayer component 30 is being assembled to the tank component 14. The tube 44 has a length such that, when the cap 32 is assembled with the tank component 14, a second end portion 47 of the tube 44 is located a short distance from the base 27 of the tank component 14, as depicted in FIG. 8. The sprayer component 30 also includes a delivery tube 48 configured to deliver or direct fluid from the fluid passage 42 to the hand sprayer 50. The delivery tube 48 has one end portion 49 fluidly coupled to the fluid passage 42 of the cap 32 and a second end portion 51 fluidly coupled to a fluid passage 57 defined in the hand sprayer 50.

Figure 6:
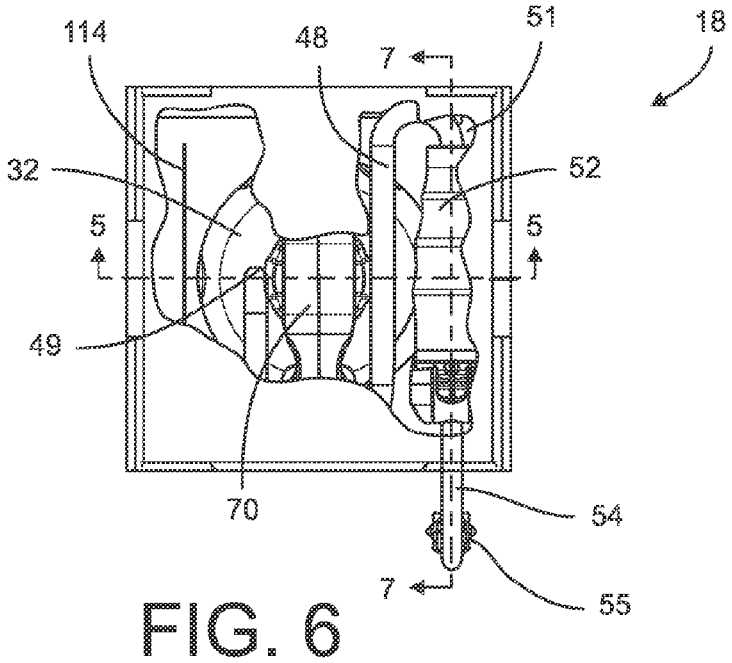
FIG. 6 is a top elevational view of the sprayer package subassembly of FIG. 1 taken along lines 6-6 of FIG. 5.

The hand sprayer 50 is configured to selectively enable fluid from the chamber 16 to be dispersed to a location outside of the chamber 16. In one embodiment, the hand sprayer 50 comprises a grip portion 52 and a wand portion 54 that extends from the grip portion 52, as best seen in FIG. 6. Fluid passages 57, 59 are defined in the grip portion 52 and the wand portion 54, respectively, so that a continuous fluid channel extends from the end portion 51 of the delivery tube 48 to a distal end portion 53 of the wand portion 54. The grip portion 52 includes a trigger 56 or other similar type of actuation mechanism that is configured to enable the flow of fluid through the passages 57, 59 to the distal end 53 of the wand 54. The wand portion 54 includes a nozzle 55 located at the distal end 53 of the wand portion 54 to control the spray pattern for the hand sprayer 50.

Figure 3:
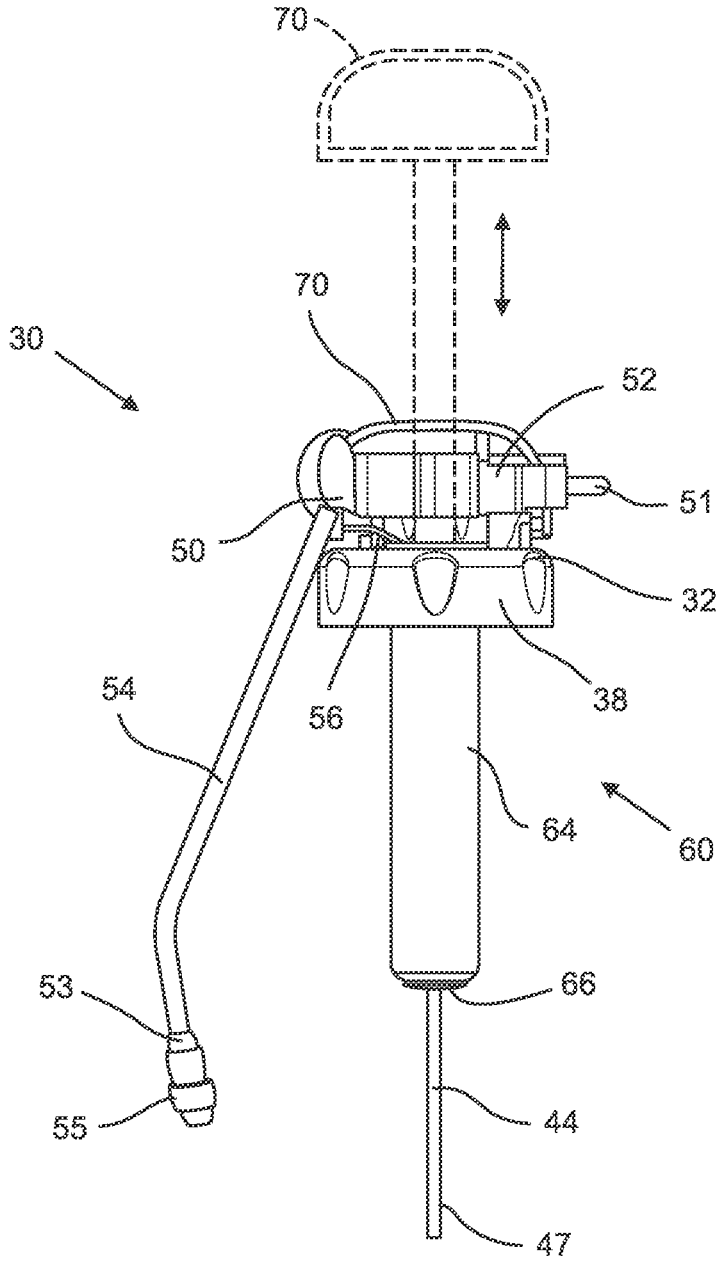
FIG. 3 is an elevational view of a sprayer component of the sprayer package subassembly of FIGS. 1 and 2.

The pump 60 includes a pump cylinder 64, a piston 68, and a handle portion 70 configured to introduce air into the chamber 16 to pressurize the chamber to cause fluid flow through the uptake tube 44 and delivery tube 48 to the hand sprayer 50. As depicted in FIGS. 3 and 5, the pump cylinder 64 of the pump 60 comprises a hollow cylinder that is aligned with a second opening 43 defined in the cap 32 and that extends from a lower side of the cap 32 through the cap space 34. During assembly of the tank sprayer assembly 10, the pump cylinder 64 is advanced through the access opening 22 of the neck 20 and into the chamber 16 of the tank component 14. Thereafter, coupling of the cap 32 to the neck 20 secures the sprayer component 30 to the tank component 14, as depicted in FIG. 8.

The piston 68 of the pump 60 is positioned in the pump cylinder 64 and is configured for axial movement with respect to the pump cylinder 64. The piston 68 and the pump cylinder 64 cooperate to define a compression chamber 71. The pump 60 includes check valves 66, 67 for controlling air flow into and out of the compression chamber 71 during movement of the piston 68 with respect to the compression chamber 71. The handle portion 70 is attached to an end of the piston 68 that extends from the cylinder 64 on the upper side of the cap 32. The handle portion 70 may be used in a known manner by an operator of the tank sprayer to axially move the piston 68 so as to introduce a positive pressure into the chamber 16 of the tank component 14. For example, the handle portion 70 of the piston 68 is configured to move between a retracted position (see, e.g., FIG. 3) and an extended position (as shown in phantom in FIG. 3). When the handle portion 70 is moved from the extended position to the retracted position, also referred to as a downstroke, the piston 68 forces air in the compression chamber 71 to move through the check valve 66 and into the chamber 16. When the handle portion 70 is moved from the retracted position to the extended position, also referred to as an upstroke, the check valve 67 opens to allow air to flow into the compression chamber 71.

Figure 4:
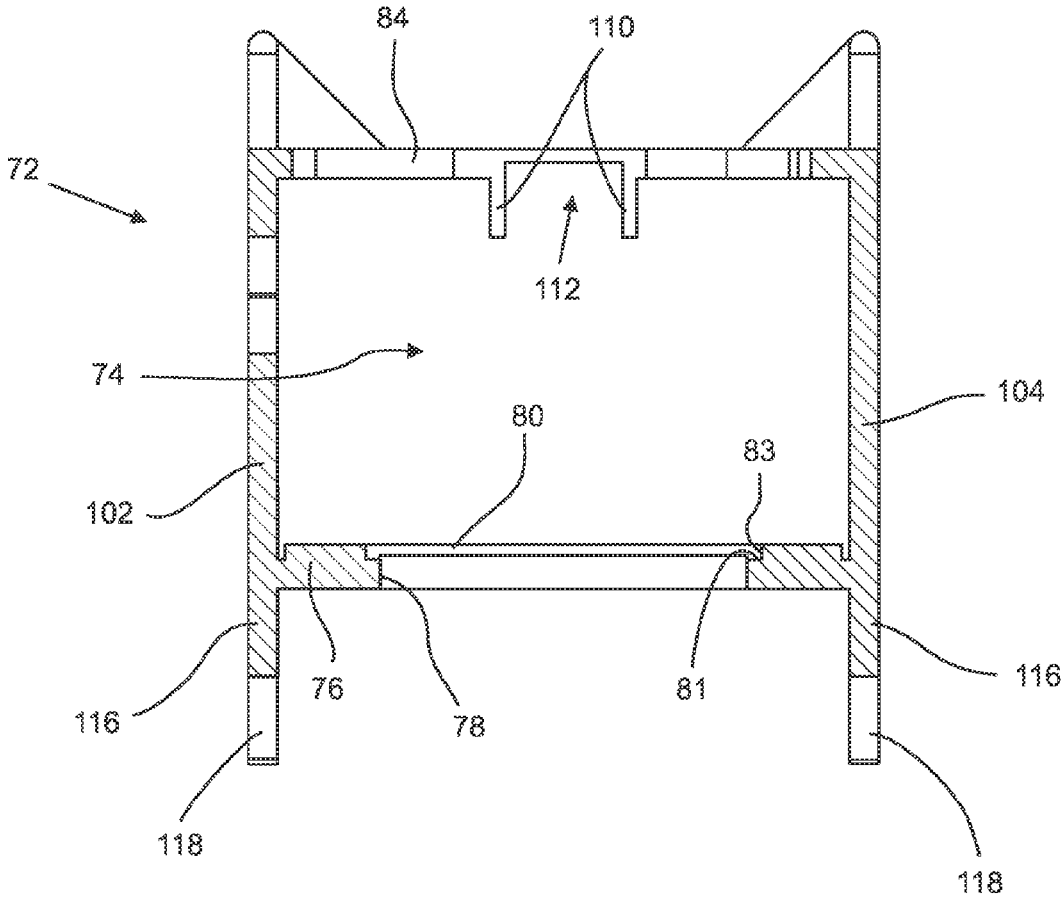
FIG. 4 is an elevational view of a package container of the sprayer package subassembly of FIGS. 1 and 2.

FIG. 4 depicts an embodiment of the package container 72 of the sprayer package subassembly 18. As shown, the package container 72 comprises a plurality of walls that define that define a cavity 74 for receiving and retaining part of the sprayer component 30 (see, e.g., FIG. 5). The package container 72 is configured to retain other items within the cavity 74. For example, an instruction booklet 114 for the tank sprayer assembly 10 is positioned and retained in the cavity 74 alongside the cap 32. The plurality of walls includes a lower wall 76 that defines an access opening 78 for the cavity 74, an upper wall 84 that is positioned opposite from the lower wall 76, and sidewalls 102, 104, 106, 108 that extend between the upper and lower walls 84, 76. The package container 72 is configured to retain an upper part of the sprayer component 30 in a fixed position in the cavity. Further, the package container 72 is configured to retain the cap 32 in alignment with the access opening 78 so that the neck 20 of the tank component 14 may be inserted through the access opening 78. With the neck 20 inserted into through the access opening 78, the threaded portion 28 of the neck 20 and the threaded portion 40 of the cap 32 may be readily threaded together or meshingly engaged to secure the sprayer component 30 to the tank component 14 while the cap 32 remains retained in positioned within the cavity 74.

To facilitate alignment of the cap 32 with the access opening 78, the lower wall 76 includes a rim structure 80 that surrounds the access opening 78. The rim structure 80 includes a recess or depression that defines a substantially horizontal surface 81, also referred to as seating surface 81, and a substantially vertical surface 83, also referred to as boundary surface 83. The seating surface 81 of the rim structure serves as a surface against which the skirt portion 38 of the cap 32 is placed when the cap 32 secured within the cavity 74. The vertical surface 83 extends from the seating surface 81 to form a receptacle structure in which the lower end portion of the skirt portion 38 is received. The upper wall 84 forms a barrier on an opposite side of the cavity 74 from the lower wall 76. The upper and lower walls 76, 84 trap the cap 32 therebetween. In particular, when the lower end portion of the skirt portion 38 is located within the receptacle defined by the surfaces 81, 83, the cap 32 is prevented from travelling upwardly by contact between a top portion of the cap 32 and a bottom side of the upper wall 84.

Figure 7:
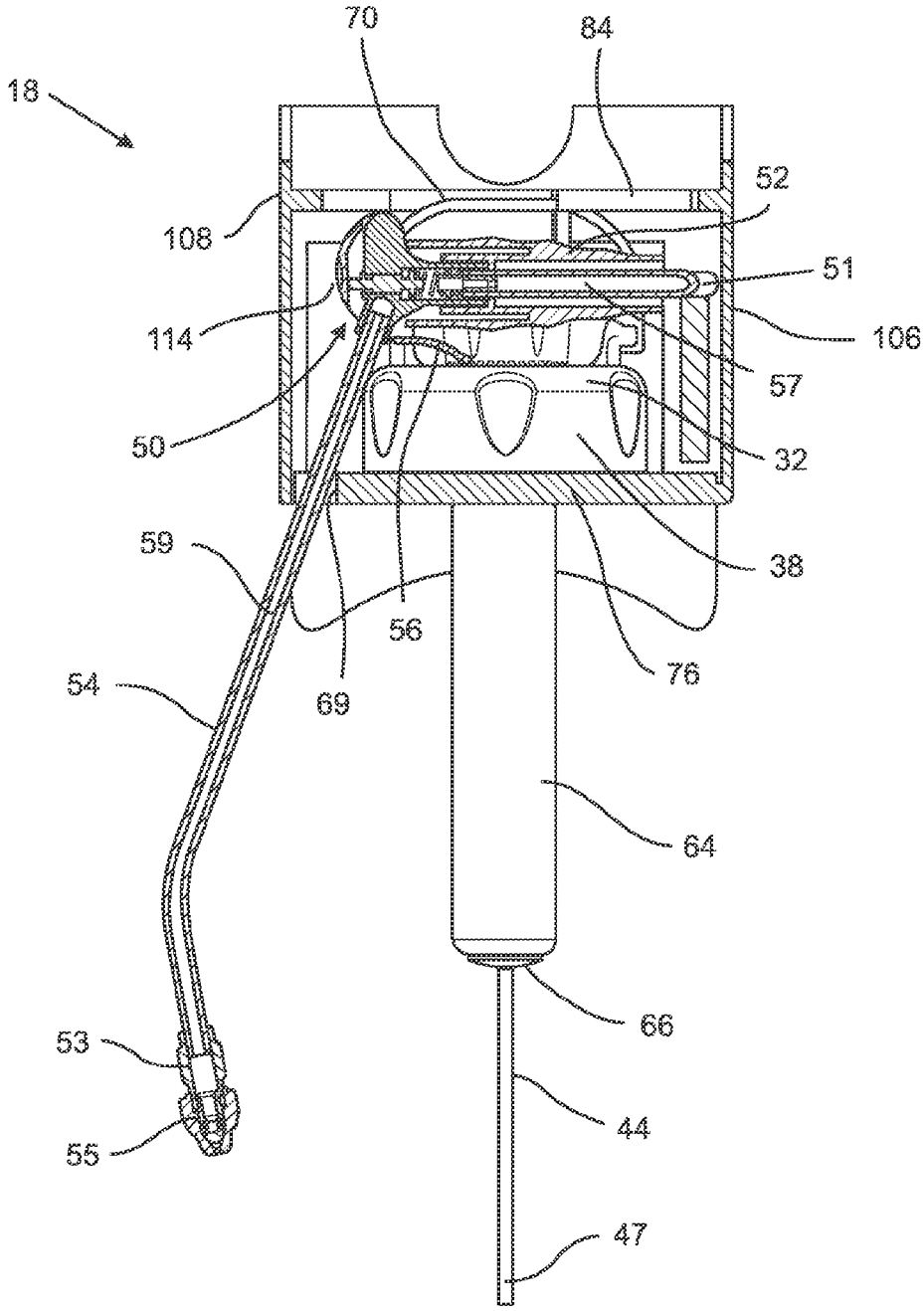
FIG. 7 is a cross-sectional view of the sprayer package subassembly of FIG. 1 taken along lines 7-7 of FIG. 6.

The upper wall 84 is configured to be movable in relation to the other walls to enable the sprayer component 30 to be advanced into the cavity 74 and the skirt portion 38 of the cap 32 to be placed in engagement with the seating surface 81 of the rim structure 80. Once the sprayer component 30 is positioned in the cavity 74, the upper wall 84 is moved back to its position shown in FIGS. 5-8 to secure the cap 32 within the cavity. When the cap 32 is positioned within the cavity 74 with the cap 32 aligned with the access opening 78, the uptake tube 44 and the pump cylinder 64 extend through the access opening 78 to be located partially exterior to the cavity as depicted in FIGS. 5 and 8. As depicted in FIG. 7, the lower wall 76 of the package 72 also defines a wand opening 69. The wand portion 54 extends through the wand opening 69 when the cap 32 is retained in the cavity. The wand opening 69 is laterally offset from the access opening 78 so that the wand portion 54 is located exterior to the neck 20 and chamber 16 of the tank component 14 when the sprayer package subassembly 18 is attached to the tank component 14, as depicted in FIG. 1.

The upper wall 84 also includes a retaining structure 110 that extends into the cavity 74 for interlocking with the handle 70 of the pump 60 to prevent lateral and/or rotational movement of the handle 70 with respect to the cavity 74. The retaining structure 110 defines a retaining space 112 that is configured to receive and interlock with the handle 70 when the sprayer component is secured in the cavity 74. The retaining structure 110 comprises a pair of posts that receive the handle 70 therebetween, as depicted in FIG. 5. In one embodiment, the piston 68 and handle portion 70 of the pump 60 may be configured to interlock with the cap 32 and/or the upper portion of the cylinder 64 to releasably secure the piston 68 and handle 70 in a retracted position with respect to the cap 32 and to prevent rotational movement of the handle 70 and piston 68 with respect to the cylinder 64. In this embodiment, using the interlocking structure 110 to prevent rotational movement of the handle 70 with respect to the cavity 74 may also prevent rotational movement of the cap 32 with respect to the cavity 74.

The sprayer package subassembly 18 that results from securing the sprayer component 30 to the package container 72 as described above provides a unitary configuration that facilitates the handling, shipping, and storing of the sprayer package assembly 18 as a separate unit from the tank component 14. The sprayer package subassembly also enables the sprayer component 30 to be easily assembled to the tank component 14 for subsequent distribution to retail centers and end users without requiring removal of the spray component 30 from the package container. For example, to secure the sprayer package subassembly 18 to the tank component 14 as depicted in FIG. 8, the neck 20 of the tank component 14 is aligned with the access opening 78 of the package container 72 and advanced so as to be partially positioned within the cavity 74 of the package container 72. With the cap 32 aligned with the access opening 78 in the interior of the cavity, advancing the neck 20 into the cavity results in the threaded portion 28 of the neck 20 to be substantially aligned with the threaded portion 40 of the cap 32. The tank component and the package container 72 may then be rotated with respect to each other with the neck 20 located at least partially in the cavity 74 to meshingly engage an externally threaded portion 28 of the neck 20 with the internally threaded portion 40 of the cap 32 so as to couple the subassembly 18 to the tank component 14.

The package container 72 is configured to engage the tank component 14 when the sprayer package subassembly 18 is coupled to the tank component to facilitate a stable and secure attachment to the tank component 14 and to resist unintentional rotation of the subassembly 18 with respect to the tank component 14. More specifically, the lower wall 76 of the package container, and in particular, the rim structure 80 may be positioned to be pinched or squeezed between the skirt portion 38 of the cap 32 and a portion of the tank component 14, such as the shoulder 24, as best seen in FIG. 8. Squeezing the rim structure 80 between the skirt 38 of the cap 32 and the shoulder 24 of the tank component 14 provides a frictional coupling between the cap 32, package container 72, and tank component 14 to resist rotational movement of the cap 32, package container 72, and tank component 14 with respect to each other.

The package container 72 also includes projections that extend below the lower wall of the container 72 toward the tank component 14. The projections are configured to be urged against the tank component 14 when the subassembly 18 is assembled to the tank component 14. For example, referring to FIGS. 1, 2, and 4, the sidewalls 102, 104 of the package container 72 respectively include projections 116 that extends below the lower wall 76 of the package container 72 on opposing sides of the lower wall 76 so that when the subassembly 18 is assembled to the tank component 14, the tank component 14 is interposed between the projections 116.

The projections 116 each have a concave terminal end 118 that is configured to contact the shoulder 24 of the tank component 14 to stabilize the subassembly 18 with respect to the tank component 14 when in the assembled configuration as depicted in FIG. 1.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. A tank sprayer assembly, comprising:

a tank component defining a chamber configured to receive fluid therein, said tank component including a neck defining a first access opening configured to allow access to said chamber, and said neck having an externally threaded portion; and a subassembly including:

a packaging container having an upper wall, a lower wall, and a plurality of side walls, the upper wall and the lower wall being spaced apart from each other to define a cavity therebetween, the plurality of side walls extending between the upper and lower walls surrounding the cavity, the lower wall defining a second access opening configured to allow access to said cavity, and a sprayer component including (i) a cap defining a cap space and having a skirt that includes an internally threaded portion facing said cap space, and (ii) a pump attached to said cap and including a cylinder and a piston movably positioned within said cylinder, the cap being retained within the cavity with the skirt held against the lower wall around the second access opening by the upper wall and with the pump extending from the cap through said second access opening, wherein said tank sprayer is positionable in an assembled configuration and disassembled configuration, wherein, when said tank sprayer is positioned in said assembled configuration, (i) said internally threaded portion of said cap is aligned with said second access opening of said lower wall, (ii) said neck extends through said second access opening of said lower wall so as to be at least partially positioned within said cavity, and (iii) said externally threaded portion of said neck is meshingly engaged with said internally threaded portion of said skirt of said cap so as to secure said sprayer component to said tank component, and wherein, when said tank sprayer is positioned in said disassembled configuration, said neck is spaced apart from said cavity of said packaging container.

2. The tank sprayer assembly of claim 1, wherein when said tank sprayer is positioned in said assembled configuration:

both said cylinder and said piston extend through said first access opening into said chamber of said tank component.

3. The tank sprayer assembly of claim 1, further comprising an instruction booklet located within said cavity of said packaging container.

4. The tank sprayer assembly of claim 1, wherein:

said lower wall of said packaging container includes a rim structure that defines said second access opening, and said skirt of said cap being retained against said rim structure within said cavity when said tank sprayer is in said disassembled position.

5. The tank sprayer assembly of claim 4, wherein:

said rim structure defines a substantially cylindrically shaped recess that faces said cavity, and said skirt of said cap is received in said substantially cylindrically shaped recess.

6. The tank sprayer assembly of claim 5, wherein:

said sprayer component further includes a handle connected to said piston, and said handle is located within said cavity and interposed between said upper wall and said cap, said handle being retained in said cavity in a retracted position with respect to said cap, said upper wall extending over said handle to obstruct movement of said handle from said retracted position.

7. The tank sprayer assembly of claim 1, wherein:

said tank component further includes a shoulder portion depending from said neck, said packaging container further includes a first projection having a first terminal end and a second projection having a first terminal end, said first projection and said second projection are spaced apart from each other, said first projection and said second projection extend from said plurality of walls, and when said tank sprayer is positioned in said assembled configuration, (i) said tank component is interposed between said first projection and said second projection, (ii) said first terminal end is positioned in contact with said shoulder portion, and (iii) said second terminal end is positioned in contact with said shoulder portion.

8. The tank sprayer assembly of claim 7, wherein:

said packaging component further includes a first sidewall and a second sidewall arranged facing each other on opposite sides of the cavity with said cap interposed between said first sidewall and said second sidewall, said first projection extends from said first sidewall beyond said lower wall, and said second projection extends from said second sidewall beyond said lower wall.

9. A method of assembling a tank sprayer assembly, comprising:

retaining a cap of a sprayer component within a packaging container to form a subassembly, the packaging container having an upper wall, a lower wall, and a plurality of side walls, the upper wall and the lower wall being spaced apart from each other to define a cavity therebetween, the plurality of side walls extending between the upper and lower walls surrounding the cavity, the lower wall defining an access opening to said cavity, the cap being retained against the lower wall over the access opening by the upper wall, the sprayer component including a pump attached to said cap, the pump extending from said cap through said access opening;

advancing a neck of a tank component through the first access opening and into engagement with an internally threaded portion of the cap within the cavity of the packaging container of the subassembly; and rotating the tank component in relation to the subassembly while the neck is located in the cavity so as to meshingly engage an externally threaded portion of the neck with the internally threaded portion of the cap so as to couple the subassembly to the tank component.

10. The method of claim 9, wherein the lower wall of the packaging container includes a rim structure that defines the first access opening, further comprising:

squeezing the rim structure between the cap and the tank component in response to the rotating step.

11. The tank sprayer assembly of claim 10, wherein the rim structure defines a substantially cylindrically shaped recess that faces the cavity, and wherein the cap includes a skirt that is received within the substantially cylindrically shaped recess.

12. The method of claim 9, wherein:

the tank component defines a chamber configured to receive fluid therein, the neck defines a second access opening that allows access to the chamber, the pump includes a cylinder and a piston movably coupled to the cylinder, and the advancing step further includes advancing both the cylinder and the piston through the second access opening and into the chamber.

13. The tank sprayer assembly of claim 12, wherein:

the sprayer component further includes a handle connected to the piston, and the handle is retained in said cavity in a retracted position with respect to said cap, said upper wall extending over said handle to obstruct movement of said handle from said retracted position.

14. A subassembly of a tank sprayer assembly, comprising:

a packaging container having an upper wall, a lower wall, and a plurality of side walls, the upper wall and the lower wall being spaced apart from each other to define a cavity therebetween, the plurality of side walls extending between the upper and lower walls surrounding the cavity, the lower wall defining an access opening configured to allow access to said cavity, and a sprayer component including (i) a cap defining a cap space and having a skirt that includes an internally threaded portion facing said cap space, and (ii) a pump attached to said cap and including a cylinder and a piston movably positioned within said cylinder, both said cylinder and said piston extending through said cap space, wherein the cap is retained within the cavity against the lower wall over the access opening by the upper wall with said internally threaded portion aligned with said access opening, and wherein both said cylinder and said piston extend from said cavity of said packaging container through said access opening.

15. The tank sprayer assembly of claim 14, wherein:

said lower wall of said packaging container includes a rim structure that defines said access opening, and said rim structure defines a substantially cylindrical shaped recess that faces said cavity, and said skirt of said cap is received in said substantial cylindrically-shaped recess.

16. The tank sprayer assembly of claim 14, wherein:

said sprayer component further includes a handle connected to said piston, and said handle is retained within said cavity in a retracted position with respect to said cap, said upper wall extending over said handle to obstruct movement of said handle from said retracted position.

17. The tank sprayer assembly of claim 16, wherein:

said packaging component further includes a first side wall, a second side wall, a first projection, and a second projection, said first side wall and said second side wall are arranged facing each other on opposite sides of the cavity with said cap interposed therebetween, said first projection extends from said first side wall beyond said lower wall, said second projection extends from said second side wall beyond said lower wall, and both said first projection and said second projection are shaped complementary to a shoulder portion of a tank component of the tank sprayer assembly.

* * * * *